US005445217A

United States Patent [19]

Castaing et al.

[11] Patent Number: 5,445,217

[45] Date of Patent: Aug. 29, 1995

[54] DEVICE FOR THE PRODUCTION OF COLD AND/OR HEAT BY SOLID-GAS REACTION

[75] Inventors: Jean Castaing, Pollestres; Pierre Neveu, Saint-Jean Lasseilles, both of France

[73] Assignee: Societe Nationale Elf Aquitaine, France

[21] Appl. No.: 129,074

[22] PCT Filed: Feb. 10, 1993

[86] PCT No.: PCT/FR93/00135

§ 371 Date: Oct. 7, 1993

§ 102(e) Date: Oct. 7, 1993

[87] PCT Pub. No.: WO93/16339

PCT Pub. Date: Aug. 19, 1993

[30] Foreign Application Priority Data

Feb. 14, 1992 [FR] France ..... 92 01680

[51] Int. Cl.[6] ..... F28D 15/00

[52] U.S. Cl. ..... 165/104.12; 62/480; 62/478

[58] Field of Search ..... 165/104.12; 62/4, 480, 62/110, 106, 112, 478, 101, 476

[56] References Cited

U.S. PATENT DOCUMENTS

| | | | |
|---|---|---|---|
| 2,087,939 | 7/1937 | Sarnmark | 62/118 |
| 4,183,227 | 1/1980 | Bouvin et al. | 62/480 |
| 4,439,994 | 4/1984 | Briley | 62/101 |
| 4,610,148 | 9/1986 | Shelton | 62/480 |
| 4,694,659 | 9/1987 | Shelton | 62/106 |
| 4,765,395 | 8/1988 | Paeye et al. | 165/104 |
| 4,976,117 | 12/1990 | Crozat et al. | 165/104.12 |
| 5,025,635 | 6/1991 | Rockenfeller et al. | 62/106 |
| 5,057,132 | 10/1991 | Lebrun et al. | 165/104.12 |
| 5,079,928 | 1/1992 | Rockenfeller et al. | 62/106 |

FOREIGN PATENT DOCUMENTS

| | | |
|---|---|---|
| 641486 | 4/1928 | France . |
| 2377589 | 8/1978 | France . |
| 2590356 | 4/1987 | France . |

*Primary Examiner*—John Rivell
*Assistant Examiner*—Christopher Atkinson
*Attorney, Agent, or Firm*—Bacon & Thomas

[57] ABSTRACT

A cooling and heating device using a chemical reaction comprising at least four reactors, each containing a salt capable of chemically reacting with a gas, an enclosure for receiving gas from the reactors and an enclosure for conveying gas to the reactors. The device is arranged so that, during the chemical reaction, two reactors are at the same higher pressure level, while two reactors are at the same lower pressure level. According to the invention, the device also comprises a heat-transporting fluid circuit for transferring heat between the reactors, operating at the same presure level.

4 Claims, 5 Drawing Sheets

DEVICE FOR THE PRODUCTION OF COLD AND/OR HEAT BY SOLID-GAS REACTION

TECHNICAL FIELD OF THE INVENTION

BACKGROUND OF THE INVENTION

The present invention relates to a device for producing cold and/or heat by solid-gas reaction.

The device to which the invention refers is based on the use of the so-called "thermochemical pump" system, whose main characteristics are as follows:

- heat energy is employed for operating the system itself; electrical energy is optionally employed only for circulating the heat-transfer fluids,
- the "chemical engine" employed is a reversible reaction between a solid and a gas of the type:

$$\langle \text{Solid A} \rangle + (G) \underset{2}{\overset{1}{\rightleftharpoons}} \langle \text{solid B} \rangle$$

The reaction is exothermic in direction 1, which means that, in this direction, it produces heat, and endothermic in direction 2, that is to say that, in this direction, it produces cold.

Such a system makes it possible to store energy in chemical form and has varied fields of application.

In addition, such a system makes it possible to produce, from a source of heat at the temperature Ts, heat at the temperature Tu such that:

$$Tu < Ts$$

In this case, this system is called "chemical heat pump".

Such a system also makes it possible to produce, from a source of heat at the temperature T's, heat at the temperature T'u such that:

$$T'u > T's$$

In this case, the system is called "chemical thermoconverter".

By virtue of this system it is possible to produce refrigeration energy from a source of heat and simultaneously to produce, from a source of heat at the temperature T''s, heat at the temperature T''u (T''u<T''s) and refrigeration energy.

Depending on circumstances, the use of the heat or of the cold produced is simultaneous with the consumption of energy at high temperature (Ts, T's, T''s) or delayed in time (storage effect).

Document EP-A-0,382,586 discloses a device for the production of cold and/or heat by solid-gas reaction, comprising two reactors, each containing a salt capable of reacting chemically with a gas, a condenser and an evaporator for the gas. The components of the device are arranged so as to allow the gas to follow a path from one reactor to the other, passing through the condenser and the evaporator. At the end of the chemical reaction the reactor which is depleted in gas is at a higher temperature than that of the reactor containing the gas which has just reacted with the salt, the two reactors being at different pressure levels. Heat is conveyed by a heat transfer system from the reactor which is at the higher temperature to the reactor which is at the lower temperature in order to increase the temperature of the latter. The chemical reaction then takes place in the reverse direction, part of the heat of one reactor being used as a source of heat for desorption of the gas from the other reactor. This heat transfer between the two reactors is used to improve the efficiency of the system.

However, this improved efficiency of the system does not completely satisfy the commercial requirements demanded in the case of such a system.

SUMMARY OF THE INVENTION

The objective of the present invention is therefore to propose a device for the production of cold and/or heat by solid-gas reaction, in which the heat transfer between the various reaction chambers of the device is optimized.

To do this, the invention proposes a device for producing cold and/or heat by chemical reaction comprising at least four reactors, each containing a salt capable of reacting chemically with a gas, a vessel intended to receive the gas from the reactors and a vessel intended to deliver the gas to the reactors, the device being arranged so that, during the chemical reaction, two reactors are at the same higher pressure level and two reactors are at the same lower pressure level, characterized in that the device additionally comprises a heat transfer fluid circuit intended to transfer heat between the reactors which are at the same pressure level.

The advantages and the operation of the present invention will appear more clearly on reading the following description, given without any limitation being applied, with reference to the attached drawings,

BRIEF DESCRIPTION OF THE FIGURES OF DRAWING

- each of FIGS. 1A and 1B is a Clapeyron diagram for a device according to a first embodiment of the invention,
- each of FIGS. 2A and 2B is a diagrammatic view of a device according to the first embodiment,
- each of FIGS. 3A and 3B is a Clapeyron diagram for a device according to a second embodiment of the invention,
- each of FIGS. 4A and 4B is a diagrammatic view of a device according to the second embodiment,
- FIG. 5 is a diagrammatic view of another device according to the second embodiment.

The operation of the devices according to the invention is based on the reaction between a salt and a gas. Since a true chemical reaction is involved, a monovariant system is present at equilibrium, that is to say that a univocal relationship exists between the temperature and the pressure, of the form $\log P = A - B/T$, in which expression P is the pressure, T is the temperature in K, and A and B are constants characteristic of the salt/gas pair employed.

DETAILED DESCRIPTION OF THE PREFERRED EMBODIMENT

Figure 1A:
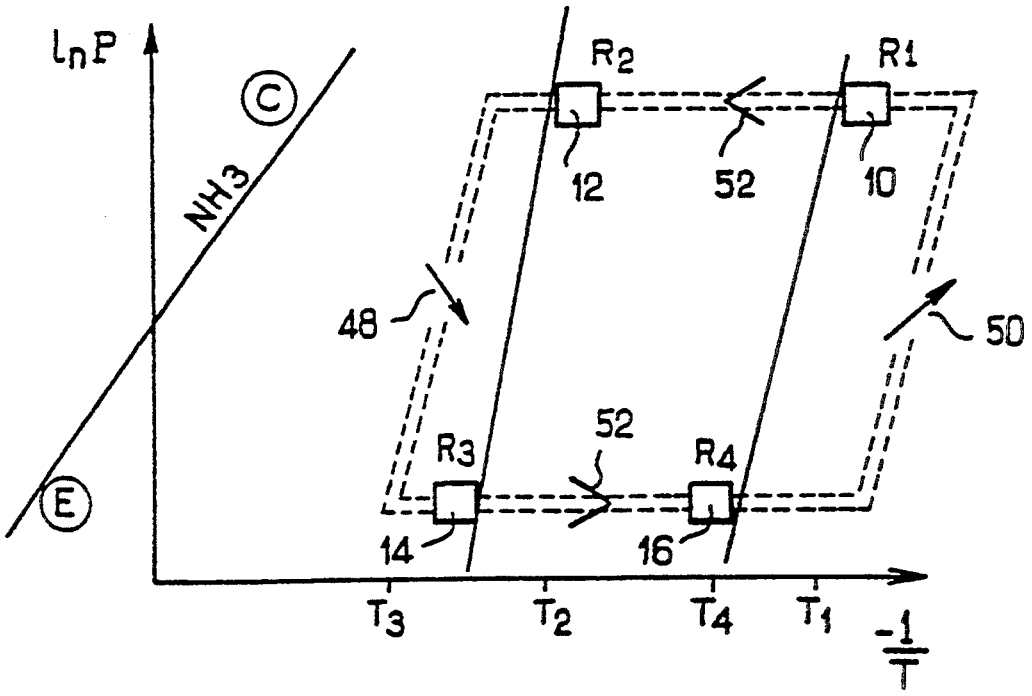
Figure 1B:
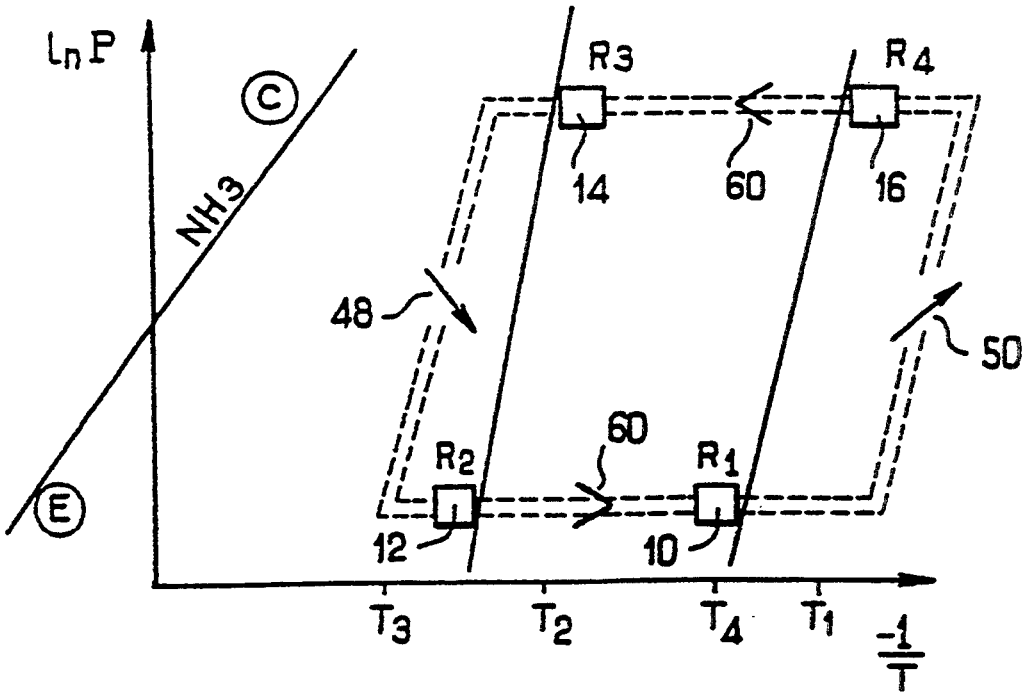

In the following description the stages of operation will be shown in a Clapeyron diagram as shown in FIGS. 1A and 1B, which include equilibrium straight lines for the salts employed.

Figure 2A:
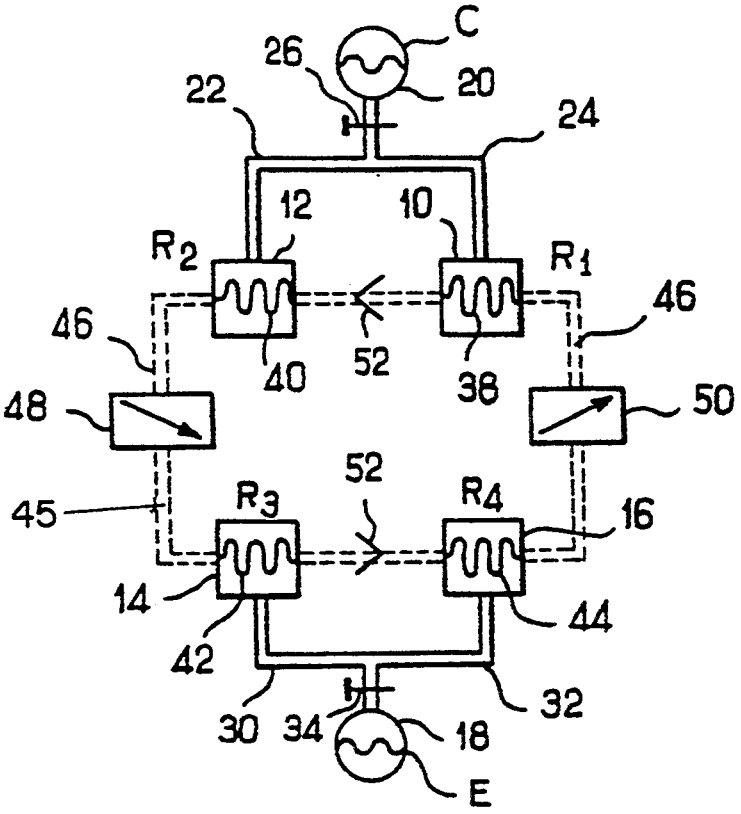
Figure 2B:
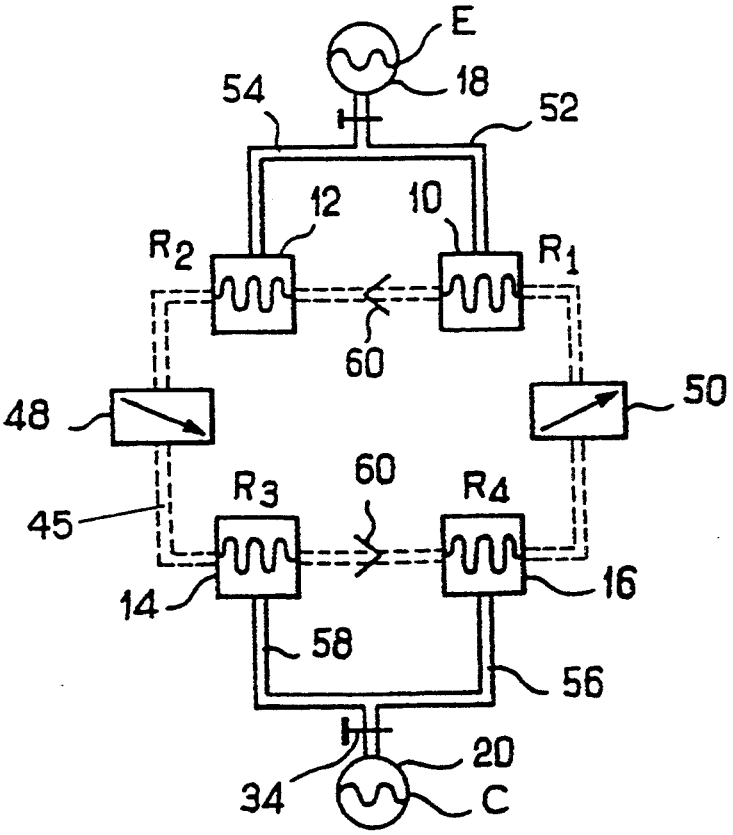

FIGS. 2A and 2B show a device for producing cold by solid-gas reaction according to a first embodiment of the invention. The device comprises four reaction chambers 10, 12, 14, 16, called reactors, made up of a vessel containing a mixture of a salt and of expanded graphite, optionally recompressed. The device additionally comprises an evaporator 18 for the gas and a condenser 20, which are arranged so as to be capable of exchanging heat with their environment.

In the example illustrated in FIG. 2A the reactors 10 and 12 are connected to the condenser 20 by conduits 22 and 24 which are provided with a valve 26 in order to be capable of selectively allowing gas to pass between the reactors 10, 12 and the condenser 20. Similarly, reactors 14 and 16 are connected to the evaporator 18 by conduits 30 and 32 which are provided with a valve 34 in order to make it possible, selectively, to allow the gas to pass between the reactors 14, 16 and the evaporator 18.

At a given instant of the reaction cycle the reactors 10, 12, 14, 16 are at the temperatures and pressures shown in the diagram in FIG. 1A. As follows from the diagram, the reactor 10 is at a temperature higher than that of the reactor 12, and the reactor 14 is at a temperature lower than that of the reactor 16.

According to the invention, instead of transferring heat from a first reactor, at a high temperature and a low pressure level, to a second reactor at a lower temperature and a higher pressure level, the heat transfer is performed between two reactors situated at the same pressure level.

As shown in FIGS. 2A and 2B, each of the reactors 10, 12, 14, 16 is provided with an associated heat exchanger 38, 40, 42 and 44, these exchangers being connected together by a conduit 46 in order to form a heat transfer circuit 45. A cooler 48 is fitted in the conduit 46 between the reactors 12 and 14, and a heating device, for example a burner 50, is fitted in the conduit 46 between the reactors 16 and 10.

When the device is started up, gas passes via the conduits 22, 24 and 30, 32 between the reactors, the condenser 20 and the evaporator 18 in accordance with the cycle shown in FIG. 1A. At a given instant in the cycle, the reactors 10, 12, 14 and 16 are at the temperatures and pressures illustrated in FIGS. 1A and 1B, the reactors 10 and 12 being at a high pressure and the reactors 14 and 16 being at a lower pressure. The heat transfer circuit 45 is started up, the heat transfer fluid circulating in the direction of the arrows 52 under the effect of a pump (not shown).

Heat originating from the reactor 10, which is at a temperature $T_1$, is conveyed to the reactor 12 which is at a lower temperature $T_2$. The heat transfer fluid, cooled after passing through the reactor 12, is next cooled further by the cooler 48 and leaves the latter at a temperature $T_3$. The cooled heat transfer fluid then passes through the reactor 14 and then through the reactor 16, which is at a temperature $T_4$, before passing through the burner 50 in order to regain the initial temperature level $T_1$.

The reaction between the salts employed in the reactors and the gas, which is, for example, ammonia, is reversible, the reactions in both directions together forming a cycle. To terminate a cycle, the reactors 10 and 12 are connected via conduits 52 and 54 to the evaporator 18, and the reactors 14 and 16 are connected to the condenser 20 by conduits 56 and 58, as shown in FIG. 2B. At the end of reaction the reactors 10 and 12 and the reactors 14 and 16 are in reversed positions in relation to those shown in FIG. 1A. The heat transfer circuit is then started up in the reverse direction, as shown by arrows 60 in FIG. 1B. The heat transfer effect produced by the passage of the heat transfer fluid is analogous to that described above.

Figure 4A:
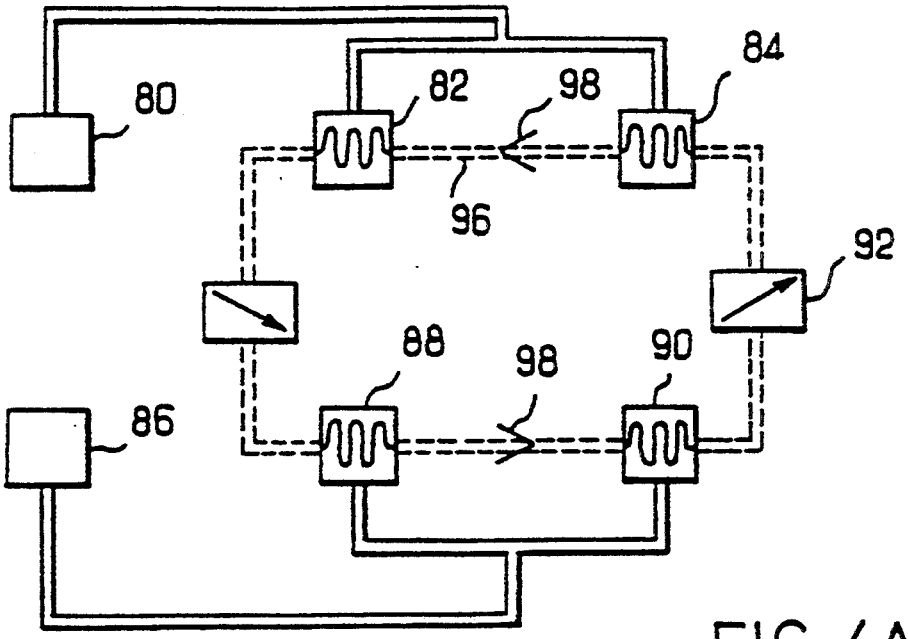
Figure 4B:
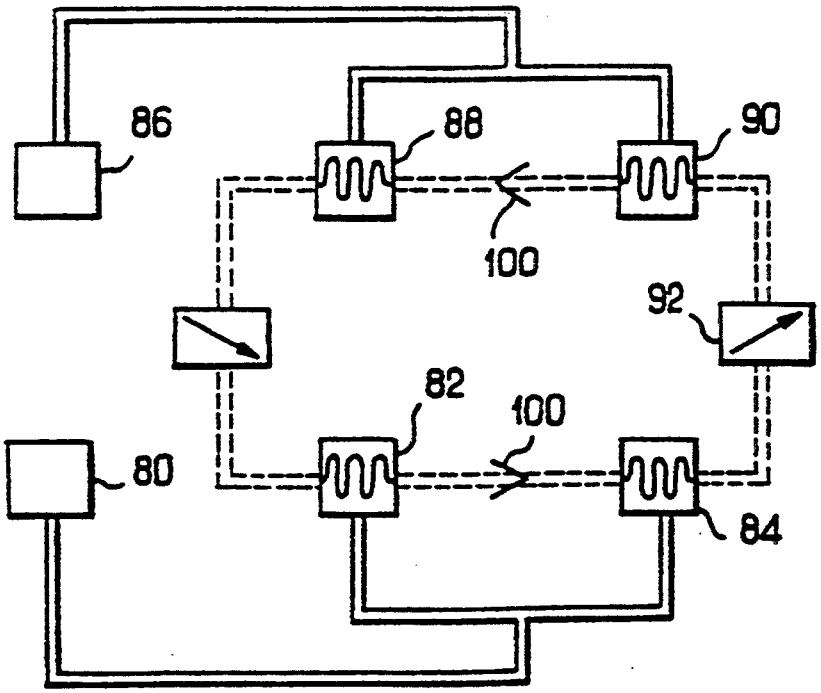

FIGS. 4A and 4B show a device for producing cold or heat by solid-gas reaction according to a second embodiment of the invention. This device differs from that in FIGS. 2A and 2B in that the condenser 20 and the evaporator 18 have been replaced with reactors. The device thus comprises six reactors 80, 82, 84, 86, 88 and 90, of which four 82, 84, 88 and 90 are connected to a burner 92 and to a cooler 94 by a heat transfer circuit 96.

Figure 3A:
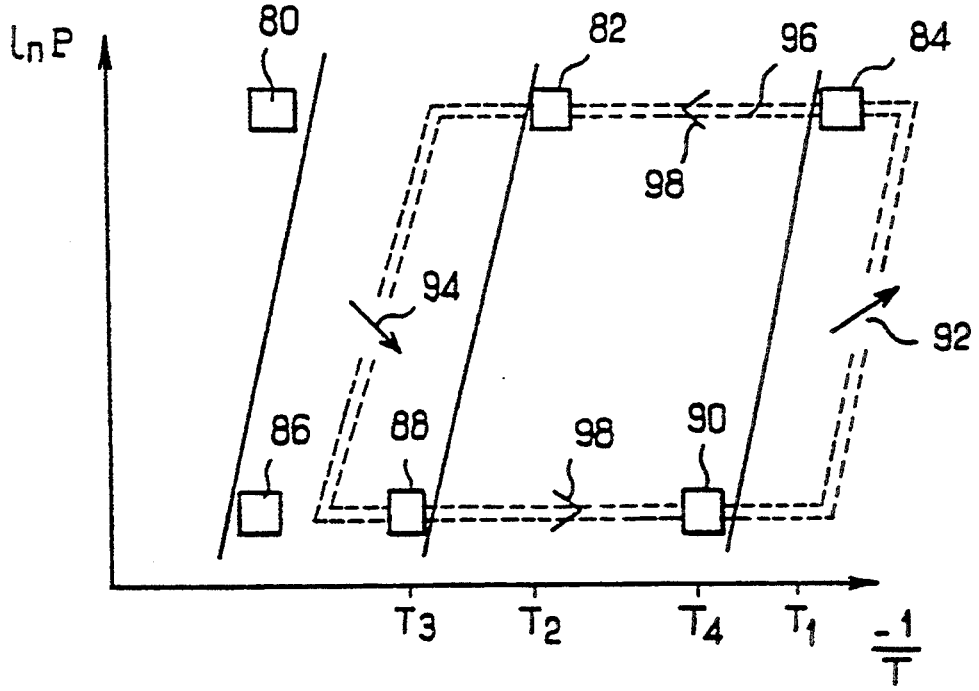

At a given moment in the reaction cycle the reactors are at the temperatures and pressures illustrated in FIG. 3A, the reactors 80, 82 and 84 being at the same pressure level but at different temperatures, the reactors 86, 88 and 90 being at the same lower pressure level, but also at different temperatures. The heat transfer circuit 96 is then started up, the heat transfer fluid circulating in the direction of the arrows 98. As in the case of the device of FIGS. 2A and 2B, the heat transfer fluid transfers the heat successively between the reactors 84 and 82 which are at the higher pressure level, the reactors being at associated temperatures $T_1$and $T_2$. The heat transfer fluid then passes through the cooler 94 in order to reduce its temperature to $T_3$ before passing successively through the reactors 88 and 90, the temperature of the fluid rising from $T_3$ to $T_4$during this passage. As in the example of FIGS. 1A and 1B, the heat transfer fluid is then heated in the burner 92 to a temperature $T_1$.

Figure 3B:
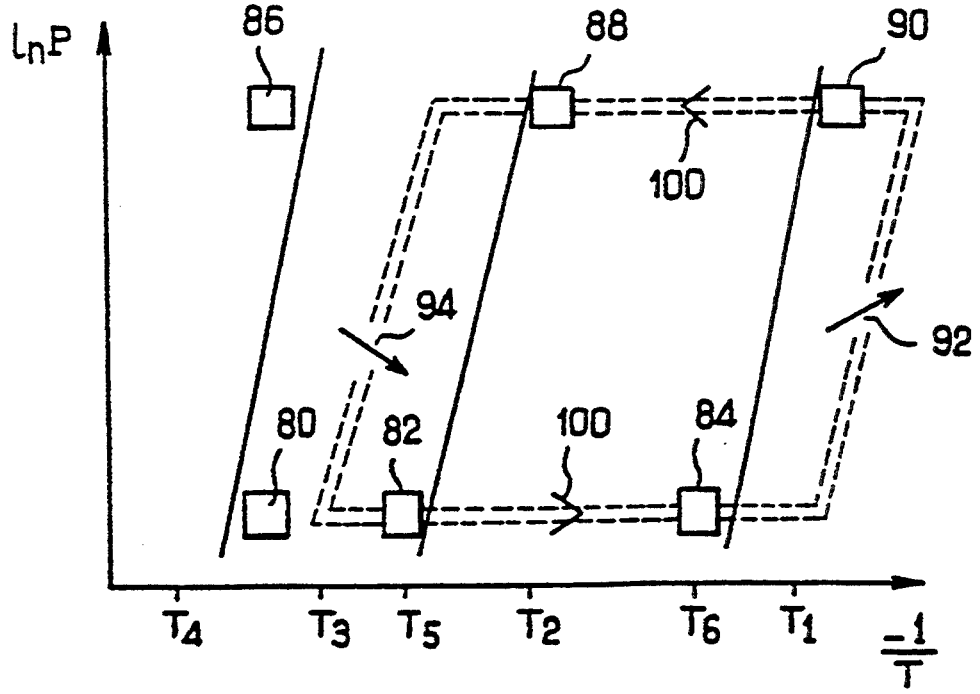

In a manner similar to that of the device of FIG. 1B, the reaction then takes place in the reverse direction and, at a given instant of the cycle, the reactors are at the temperatures and pressures shown in FIG. 3B. As shown in FIGS. 3B and 4B, the heat transfer fluid circulates in reverse direction, as shown by the arrows 100.

Thus, according to the invention, during each stage of the reaction cycle, a heat transfer circuit ensures the heat transfer between the reactors which are at the same high pressure level, the heat flowing from a reactor which is at a given temperature to a reactor at a lower temperature. As for the reactors which are at the same lower pressure level, the heat transfer fluid is heated during its passage through the successive reactors, the heat transfer fluid passing from a reactor at a given temperature to a reactor at a higher temperature.

Figure 5:
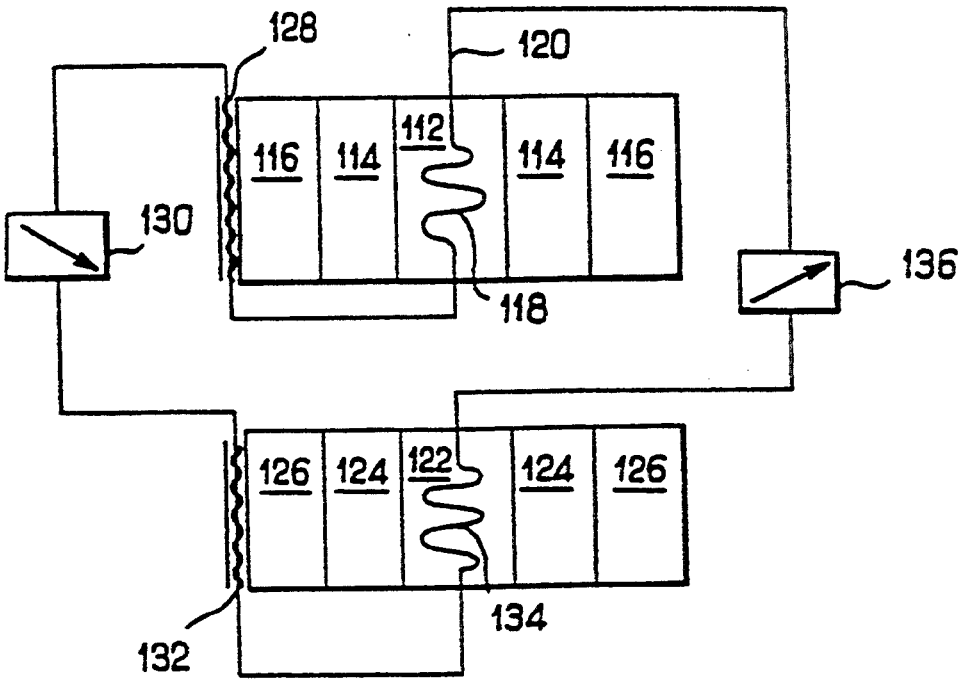

Each of the devices of FIGS. 1A,B–4A,B comprises a heat transfer circuit intended to transfer heat from a first reactor to a second one. FIG. 5 shows a device in which the heat flows from one reactor to another of the same series solely by conduction, that is to say without any resort to a heat transfer circuit between the reactors.

In this example, a cylindrical reactor 112 is arranged inside a first annular reactor 114, itself arranged inside a second annular reactor 116, the three reactors being arranged so as to ensure good thermal conductivity between them. A heat exchanger 118 connected to a heat transfer circuit shown diagrammatically as 120 is arranged inside the cylindrical reactor 112. In the example illustrated, this set of three reactors 112, 114 and 116 is connected to a similar second set which is made up of three reactors 122, 124 and 126. After passing through the heat exchanger 118, the heat transfer fluid passes through another heat exchanger 128, which is in thermal communication with the reactor 116. The fluid then passes through a cooler 130, a heat exchanger 132 in thermal communication with the reactor 126 an exchanger 134 arranged inside the reactor 122, and a burner 136, before passing again through the exchanger 118. The operation of a device of this type is similar to that of the device of FIGS. 3A,B and 4A,B.

The performance of a device for producing cold and/or heat by chemical solid-gas reaction can be evaluated by employing the economic concept of the coefficient of performance or COP.

By way of example, the COP of a device corresponding to that of FIG. 2A is calculated.

In this example each of the reactors 12 and 14 contains $CaCl_2$ reacting with 4 moles of ammonia, that is $CaCl_2.8NH_3$ to $4NH_3$, and each of the reactors 10 and 16 contains $NiCl_2$ reacting with 4 moles of ammonia, that is $NiCl_2.6NH_3$ to $2NH_3$.

The temperature of the heat transfer fluid leaving the burner 50 is 285° C., the temperature T3 is 35° C. and at the exit of the evaporator is 5° C.

The COP defined by the ratio of the cold energies produced in relation to the high temperature energy is equal to 1.07, given that the heating or the cooling of the heat transfer fluid in a reactor during absorption or desorption of the gas corresponds to 80% of the maximum possible rise or of the maximum possible decrease. This corresponds to the difference between the entry temperature of the heat transfer fluid and the equilibrium temperature of the reactant at the pressure being considered.

If, in the case of the same device, the condenser is replaced with a reactor 80 containing $BaCl_2$ (8-$ONH_3$), and the evaporator is replaced with a reactor 86 containing the same salt, the COP is 1.60.

In each embodiment heat is transferred between the reactors which are at the same given pressure level at an instant of the cycle. This heat transfer can be performed by a heat transfer fluid or by simple conduction. The reactors which are at the same pressure level can be connected to an associated heat transfer circuit or to a circuit which is common to all the reactors of the device.

The device according to the invention may comprise two series of reactors, each series being made up of a number of reactors and being intended to be connected together to a condenser or to an evaporator. Alternatively, the condenser and the evaporator may each be replaced by an associated reactor which is intended to receive or to release the gas.

We claim:

1. Device for producing cold and/or heat by chemical reaction comprising at least four reactors, each containing a salt capable of reacting chemically with a gas, a vessel intended to receive the gas from the reactors and a vessel intended to deliver the gas to the reactors, the device being arranged so that, during the chemical reaction, two reactors are at the same higher pressure level and two reactors are at the same lower pressure level, the device additionally comprising a heat transfer fluid circuit intended to transfer heat between the reactors which are at the same pressure level, wherein the heat transfer fluid circuit is closed and connects the four reactors, this circuit additionally comprising a cooler and a heating device for a fluid in the heat transfer fluid circuit.

2. Device according to claim 1, wherein the heat transfer fluid circuit comprises, in the direction of flow of the fluid, the reactors being at the higher pressure level in order of decreasing temperature, the cooler, the reactors being at the lower pressure level in order of increasing temperature, and the heating device.

3. Device according to claim 1, wherein the vessel intended to receive the gas comprises a condenser, the vessel intended to deliver the gas comprising an evaporator.

4. Device according to claim 1, wherein the vessel intended to receive the gas and the vessel intended to deliver the gas each comprise a reactor.

* * * * *